US006745646B1

(12) United States Patent
Pietras et al.

(10) Patent No.: US 6,745,646 B1
(45) Date of Patent: Jun. 8, 2004

(54) APPARATUS AND METHOD FOR FACILITATING THE CONNECTION OF PIPES

(75) Inventors: Bernd-Georg Pietras, Wedemark (DE); Joerg-Erich Schulze-Beckinghausen, Garbsen (DE)

(73) Assignee: Weatherford/Lamb, Inc., Houston, TX (US)

( * ) Notice: Subject to any disclaimer, the term of this patent is extended or adjusted under 35 U.S.C. 154(b) by 32 days.

(21) Appl. No.: 10/048,353

(22) PCT Filed: Jul. 14, 2000

(86) PCT No.: PCT/GB00/02723

§ 371 (c)(1),
(2), (4) Date: Jun. 11, 2002

(87) PCT Pub. No.: WO01/09479

PCT Pub. Date: Feb. 8, 2001

(30) Foreign Application Priority Data

Jul. 29, 1999 (GB) ..... 9917696
Jul. 29, 1999 (GB) ..... 9917697

(51) Int. Cl.[7] ..... B25B 13/50
(52) U.S. Cl. ..... 81/57.34; 81/57.19; 81/57.21
(58) Field of Search ..... 81/57.34, 57.19, 81/57.21, 57.33, 57.15, 57.16, 57.44

(56) References Cited

U.S. PATENT DOCUMENTS

| | | | | |
|---|---|---|---|---|
| 1,386,908 | A | 8/1921 | Taylor | |
| 1,842,638 | A | 1/1932 | Wigle | |
| 2,214,194 | A | 9/1940 | Frankley | 251/84 |
| 2,214,429 | A | 9/1940 | Miller | 166/16 |
| 2,522,444 | A | 9/1950 | Grable | 166/16 |
| 2,610,690 | A | 9/1952 | Beatty | 166/16 |
| 2,950,639 | A | 8/1960 | Mason | 81/53 |
| 3,021,739 | A | 2/1962 | Grundmann | 81/53 |
| 3,041,901 | A | 7/1962 | Knights | 81/53 |
| 3,086,413 | A | 4/1963 | Mason | 81/53 |
| 3,122,811 | A | 3/1964 | Gilreath | 24/263 |
| 3,131,566 | A | 5/1964 | Wilson | 81/52.4 |
| 3,180,186 | A | 4/1965 | Catland | 81/57 |
| 3,220,245 | A | 11/1965 | Winkle | 73/46 |
| 3,302,496 | A | 2/1967 | Mitchell et al. | 81/53 |
| 3,349,455 | A | 10/1967 | Doherty | 24/263 |
| 3,443,291 | A | 5/1969 | Doherty | 24/263 |
| 3,475,038 | A | 10/1969 | Matherine | 285/27 |
| 3,518,903 | A | 7/1970 | Ham et al. | 81/57.16 |
| 3,559,739 | A | 2/1971 | Hutchinson | 166/311 |
| 3,680,412 | A | 8/1972 | Mayer et al. | 81/57.34 |
| 3,722,331 | A | 3/1973 | Radulescu | 81/52.4 |
| 3,747,675 | A | 7/1973 | Brown | 166/237 |

(List continued on next page.)

FOREIGN PATENT DOCUMENTS

| | | |
|---|---|---|
| DE | 2 128 362 | 1/1972 |
| EP | 0 285 386 | 5/1988 |
| EP | 0 339 005 A | 10/1989 |

(List continued on next page.)

OTHER PUBLICATIONS

International Search Report Dated Oct. 17, 2000, for Application Serial Number PCT/GB00/02723.

*Primary Examiner*—D. S. Meislin
(74) *Attorney, Agent, or Firm*—Moser, Patterson & Sheridan, L.L.P.

(57) ABSTRACT

An apparatus for facilitating the connection of pipes comprises a rotary (4) and a stator (5), the rotary comprising at least one hydraulically actuated jaw (24,25,26), and a pump (58) arranged on the rotary (4) for pumping hydraulic fluid for actuation of the or each jaw (24,25,26), the stator comprising a motor (55) arranged on the stator (5), so that rotational energy can be transferred from the motor to the pump in an operational configuration.

19 Claims, 12 Drawing Sheets

U.S. PATENT DOCUMENTS

| | | | | |
|---|---|---|---|---|
| 3,796,418 | A | 3/1974 | Carlberg | 269/26 |
| 3,808,916 | A | 5/1974 | Porter et al. | 81/57.19 |
| 3,838,613 | A | 10/1974 | Wilms | 81/57.34 |
| 3,933,108 | A | 1/1976 | Baugh | 114/0.5 D |
| 3,941,348 | A | 3/1976 | Mott | 251/58 |
| 3,986,564 | A | 10/1976 | Bender | 173/4 |
| 4,005,621 | A | 2/1977 | Turner, Jr. et al. | 81/57.2 |
| 4,142,739 | A | 3/1979 | Billingsley | 285/18 |
| 4,159,637 | A | 7/1979 | Lamb et al. | 73/46 |
| 4,170,908 | A | 10/1979 | Peveto et al. | 81/57.11 |
| 4,221,269 | A | 9/1980 | Hudson | 173/163 |
| 4,246,809 | A | 1/1981 | Keast et al. | 81/57.16 |
| 4,257,442 | A | 3/1981 | Claycomb | 137/238 |
| 4,262,693 | A | 4/1981 | Giebeler | 137/494 |
| 4,291,762 | A | 9/1981 | Gudgel | 166/85 |
| 4,295,527 | A | 10/1981 | Russe | 166/135 |
| 4,315,553 | A | 2/1982 | Stallings | 175/207 |
| 4,334,444 | A | 6/1982 | Carstensen et al. | 81/57.18 |
| 4,346,629 | A | 8/1982 | Kinzbach | 81/57.2 |
| 4,401,000 | A | 8/1983 | Kinzbach | 81/57.2 |
| 4,402,239 | A | 9/1983 | Mooney | 81/57.16 |
| 4,442,892 | A | 4/1984 | Delesandri | 166/85 |
| RE31,699 | E | 10/1984 | Eckel | 73/862.25 |
| 4,492,134 | A | 1/1985 | Reinholdt et al. | 81/57.34 |
| 4,499,919 | A | 2/1985 | Forester | 137/613 |
| 4,565,003 | A | 1/1986 | McLeod | 29/281.1 |
| 4,573,359 | A | 3/1986 | Carstensen | 73/761 |
| 4,593,773 | A | 6/1986 | Skeie | 175/85 |
| 4,643,259 | A | 2/1987 | Zeringue, Jr. | 166/77.5 |
| 4,649,777 | A | 3/1987 | Buck | 81/57.19 |
| 4,709,766 | A | 12/1987 | Boyadjieff | 175/52 |
| 4,712,284 | A | 12/1987 | Coyle, Sr. et al. | 29/240 |
| 4,715,625 | A | 12/1987 | Shows, Jr. et al. | 285/145 |
| 4,773,218 | A | 9/1988 | Wakita et al. | 60/476 |
| 4,811,635 | A | 3/1989 | Falgout, Sr. | 81/57.33 |
| 4,938,109 | A | 7/1990 | Torres et al. | 81/467 |
| 4,979,356 | A | 12/1990 | Vatne | 81/57.16 |
| 5,000,065 | A | 3/1991 | Haynes | 81/57.2 |
| 5,022,472 | A | 6/1991 | Bailey et al. | 175/195 |
| 5,044,232 | A | 9/1991 | Schulze-Beckinghausen | 81/57.18 |
| 5,092,399 | A | 3/1992 | Lang | 166/77.5 |
| 5,150,642 | A | 9/1992 | Moody et al. | 81/57.2 |
| 5,159,860 | A | 11/1992 | Pietras | 81/57.19 |
| 5,161,438 | A | 11/1992 | Pietras | 81/57.16 |
| 5,167,173 | A | 12/1992 | Pietras | 81/57.15 |
| 5,209,302 | A | 5/1993 | Robichaux et al. | 166/355 |
| 5,221,099 | A | 6/1993 | Jansch | 279/151 |
| 5,259,275 | A | 11/1993 | Schulze-Beckinghausen | 81/57.16 |
| 5,297,833 | A | 3/1994 | Willis et al. | 294/102.2 |
| 5,390,568 | A | 2/1995 | Pietras | 81/57.16 |
| 5,451,084 | A | 9/1995 | Jansch | 294/1.1 |
| 5,520,072 | A | 5/1996 | Perry | 81/57.16 |
| 5,634,671 | A | 6/1997 | Watkins | 285/18 |
| 5,709,893 | A | 1/1998 | McCarville et al. | 166/86.1 |
| 5,730,471 | A | 3/1998 | Schulze-Beckinghausen et al. | 285/18 |
| 5,746,276 | A | 5/1998 | Stuart | 173/1 |
| 5,787,982 | A | 8/1998 | Bakke | 166/242.6 |
| 5,819,605 | A | 10/1998 | Buck et al. | 81/57.33 |
| 5,839,330 | A | 11/1998 | Stokka | 81/57.33 |
| 5,842,390 | A | 12/1998 | Bouligny et al. | 81/57.34 |
| 5,845,549 | A | 12/1998 | Bouligny | 81/57.33 |
| 5,890,549 | A | 4/1999 | Sprehe | 175/71 |
| 5,992,801 | A | 11/1999 | Torres | 248/49 |
| 6,065,372 | A | 5/2000 | Rauch | 81/57.15 |
| 6,082,224 | A | 7/2000 | McDaniels et al. | 81/57.15 |
| 6,082,225 | A | 7/2000 | Richardson | 81/57.16 |
| 6,119,772 | A | 9/2000 | Pruet | 166/81.1 |
| 6,138,529 | A | 10/2000 | Pietras | 81/57.33 |
| 6,161,617 | A | 12/2000 | Gjedebo | 166/77.52 |
| 6,206,096 | B1 | 3/2001 | Belik | 166/77.51 |
| 6,223,629 | B1 | 5/2001 | Bangert | 81/57.15 |
| 6,305,720 | B1 | 10/2001 | Spiering et al. | 285/18 |
| 6,327,938 | B1 | 12/2001 | Pietras | 81/57.33 |
| 6,330,911 | B1 | 12/2001 | Allen et al. | 166/77.51 |
| 6,360,633 | B2 | 3/2002 | Pietras | 81/57.34 |
| 6,412,554 | B1 | 7/2002 | Allen et al. | 166/80.1 |
| 6,480,811 | B2 | 11/2002 | Denny et al. | 702/188 |

FOREIGN PATENT DOCUMENTS

| | | |
|---|---|---|
| EP | 0 311 455 | 12/1989 |
| EP | 0 423 055 | 4/1991 |
| EP | 0 525 247 | 3/1993 |
| GB | 1 215 967 | 12/1970 |
| GB | 2 049 518 | 12/1980 |
| GB | 2 128 526 | 5/1984 |
| GB | 2 300 896 A | 11/1996 |
| GB | 2 346 576 | 8/2000 |
| GB | 2 346 577 | 8/2000 |
| WO | WO 83/03443 | 10/1983 |
| WO | WO 92/18744 | 10/1992 |
| WO | WO 93/18276 | 9/1993 |
| WO | WO 95/20471 | 8/1995 |
| WO | WO 98/16716 | 4/1998 |
| WO | WO 98/32948 | 7/1998 |
| WO | WO 99/34089 | 7/1999 |
| WO | WO 99/34090 | 7/1999 |
| WO | WO 99/34091 | 7/1999 |
| WO | WO 00/22278 | 4/2000 |
| WO | WO 00/23686 | 4/2000 |
| WO | WO 00/45026 | 8/2000 |
| WO | WO 00/45027 | 8/2000 |
| WO | WO 00/79092 | 12/2000 |
| WO | WO 01/03889 A1 | 1/2001 |
| WO | WO 01/09479 | 2/2001 |
| WO | WO 01/38688 | 5/2001 |
| WO | WO 01/66905 A3 | 9/2001 |

APPARATUS AND METHOD FOR FACILITATING THE CONNECTION OF PIPES

This invention relates to an apparatus and a method for facilitating the connection of pipes, and more particularly, but not exclusively, to a powered drill pipe tong for facilitating the connection of sections or stands of drill pipe.

Drill pipe tongs are commonly used for facilitating the connection of sections or stands of drill pipe to a pipe string. Typically, the pipe string hangs in a wellbore from a spider in a floor of an oil or gas rig.

A section or stand of drill pipe to be connected to the pipe string is swung in from a drill pipe rack to the well centre above the pipe string. A pipe handling arm may be used to guide the drill pipe to a position above the pipe string. A stabbing guide may then be used to align a threaded pin of the drill pipe with a threaded box of the pipe string. A drill pipe tong is then used to tighten the connection to a torque of typically 68,000 Nm (50,000 lb.ft).

The drill pipe tong is also used for disconnecting drill pipe. This operation involves breaking the connection which requires a torque typically greater than the tightening torque which may typically be used in the order of 11,000 Nm (80,000 lb.ft).

A drill pipe tong generally comprises jaws mounted in a rotary which is rotatably arranged in a housing. The jaws are moveable relative to the rotary in a generally radial direction towards and away from an upset part of the pipe to be gripped. The upset parts of the pipe are generally located above the pin and below the box of the pipe and have an enlarged outer diameter and/or a reduced inner diameter.

In use, the rotary is rotated forcing the jaws along cam surfaces towards the upset part of the section of pipe. Once the jaws fully engage the upset part, the rotary carries on rotating applying torque to the threads and hence tightens the connection between the section of pipe and the pipe string.

Several problems have been observed with such prior art drill pipe tongs.

In particular, such drill pipe tongs can badly scar the upset part of the pipe, particularly if the jaws start rotating relative to the drill pipe.

Once scarred, the pipe is then lowered into the wellbore. Friction between the wellbore (or casing lining the wellbore) and the scarred upset grinds the upset, reducing the diameter.

Scarring of the upset may also be caused by having to reapply the jaws. This is especially common when connecting pipe with "wedge threads" which requires approximately 80° of turn in order to torque the connection. Many prior art wrenching tongs need to be reapplied to the pipe every 25°.

A reduction in diameter of the upset requires the use of a drill pipe tong or for the old drill pipe tong to be modified therefor.

An attempt at solving this problem is disclosed in PCT publication Number WO 92/18744, which discloses a rotary comprising hydraulically operated active jaws and stationary passive jaws. The hydraulically activated jaws are engaged fully with the pipe prior to rotation of the rotary, thereby substantially reducing scarring. A hydraulic circuit is provided on the rotary for actuating the jaws. A plunger is used to activate the hydraulic system by depressing a hydraulic piston of the hydraulic circuit repeatedly. This operation takes time. If several seconds can be saved per connection, the overall cost of the construction of an oil or gas well can be drastically reduced, as long as reliability is not sacrificed.

Another problem associated with the rotary disclosed in PCT Publication Number WO 92/18744 is that repeated depressing of the plunger for engaging the jaws fully with the pipe may itself cause some scarring.

A further problem associated with power tongs is how to move jaws into engagement with a tubular with sufficient force and sufficient speed.

A still further problem associated with a rotary for power tong is how to fit a mechanism for applying jaws to a tubular into the confined space of a rotary. In particular, the problem arises that if a pump is provided on the rotary for pumping hydraulic fluid, the means of supplying power to the pump must be disconnected before the rotary can be rotated to torque the connection between pipes. This further adds to the overall time of the operation.

If a pump is not provided on the rotary, the hydraulic pressure must be provided via a hose attached to the rotary, and this also must be disconnected before the rotary can be rotated.

Accordingly, a first aspect of the invention provides an apparatus for facilitating the connection of pipes, which apparatus comprises a rotary (4) and a stator (5), said rotary (4) comprising at least one jaw (24,25,26), at least one piston (15,16,17) arranged in at least one cylinder (18,19,20) for actuating said at least one jaw (24,25,26), and a hydraulic circuit (100) linking a first chamber in front of said piston (15,16,17) and a second chamber to a rear side of said piston (15,16,17) such that, in use, hydraulic fluid is expelled from one of said first or second chambers and replenishes the other of said first and second chambers.

Other features of the first aspect of the invention are set out in claims 2 to 12.

There is also provided a method for facilitating the connection of pipes, comprising engaging a motor attached to a stator with a pump attached to a rotor and transferring rotational energy from the motor to the pump, enabling the pump to drive hydraulic fluid to actuate at least one jaw. In a preferred embodiment, the method comprises the step of moving the motor from a first position in which it is disengaged from the pump to a second position in which the motor and the pump are engaged to transfer rotational energy from the motor to the pump. A second aspect of the invention provides an apparatus for facilitating the connection of pipes which apparatus comprises a rotary and a stator, said rotary comprising at least one jaw, at least one piston arranged in at least one cylinder for actuating said at least one jaw, and a hydraulic circuit linking a first chamber in front of said piston and a second chamber to a rear side of said piston such that, in use, hydraulic fluid is expelled from one of said first or second chambers and replenishes the other of said first or second chambers.

There is also provided a method for facilitating the connection of pipes, the method using the apparatus of the first aspect of the invention, the method comprising the step of expelling hydraulic fluid from one of said front or rear sides of said piston and replenishing the other of said front or rear sides of said piston.

A third aspect of the invention provides an apparatus for facilitating the connection of pipes which apparatus comprises a rotary and a stator, said rotary comprises at least one jaw and at least one piston arranged in at least one cylinder for actuating said at least one jaw, and a hydraulic circuit, wherein said hydraulic circuit comprises a valve preventing return flow of hydraulic fluid and a restriction such that, in use, the arrangement allows a finite force to be applied to said pipe.

There is also provided a method for facilitating the connection of pipes, the method using the apparatus of the second aspect of the invention, the method comprising the step of allowing hydraulic fluid to leak from said hydraulic circuit such that said at least one jaw applies a finite force to said pipe.

For a better understanding of the invention, reference will now be made, by way of example, to the accompanying drawings, in which.

Figure 1:
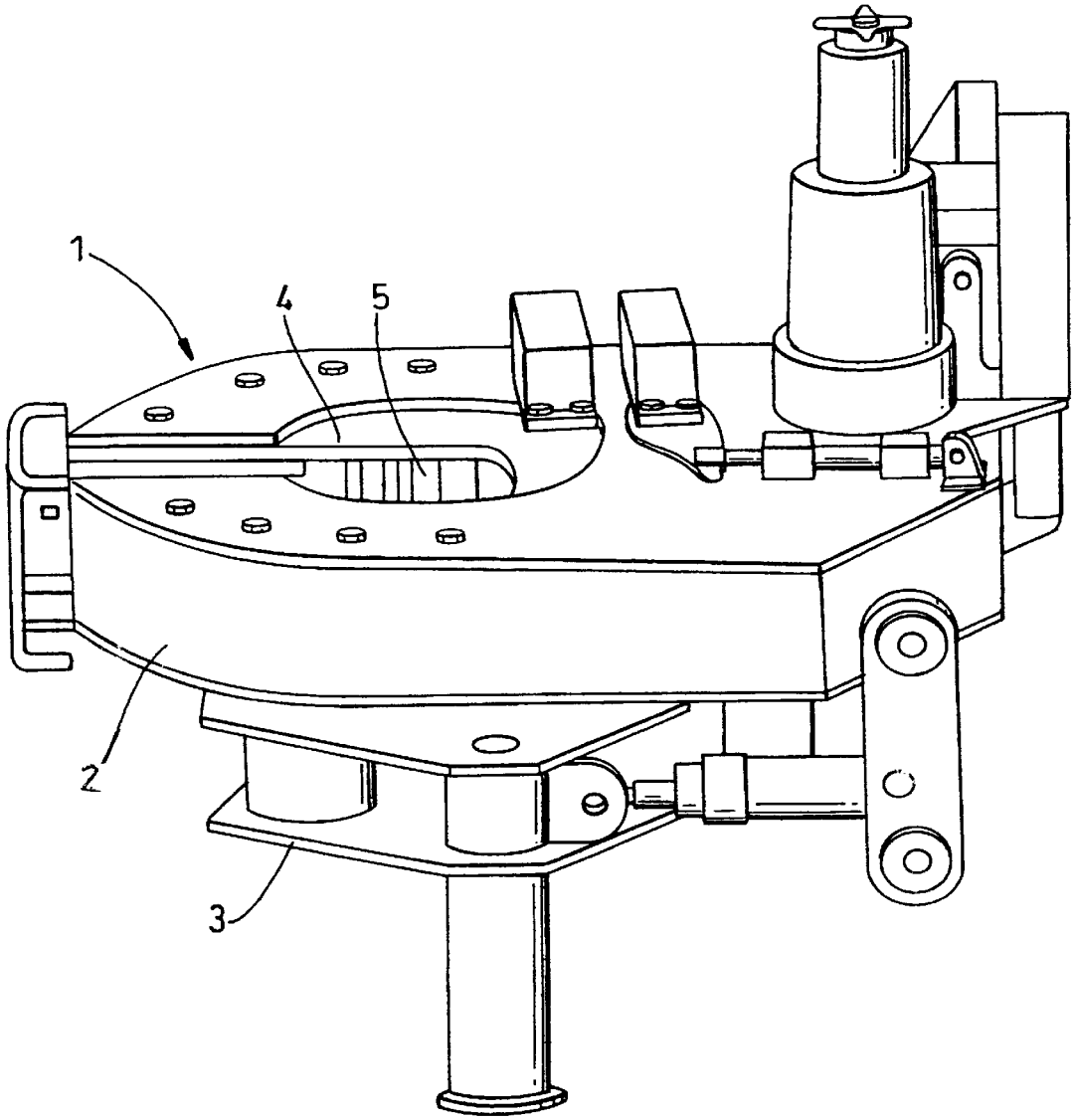
FIG. 1 is a perspective view of an apparatus in accordance with the invention prior to use.

Referring to FIG. 1 there is shown an apparatus which is generally identified by reference numeral 1.

The apparatus 1 comprises a drill pipe tong 2 and a backup unit 3.

The drill pipe tong 2 comprises a rotary 4 and a stator 5.

Figure 2:
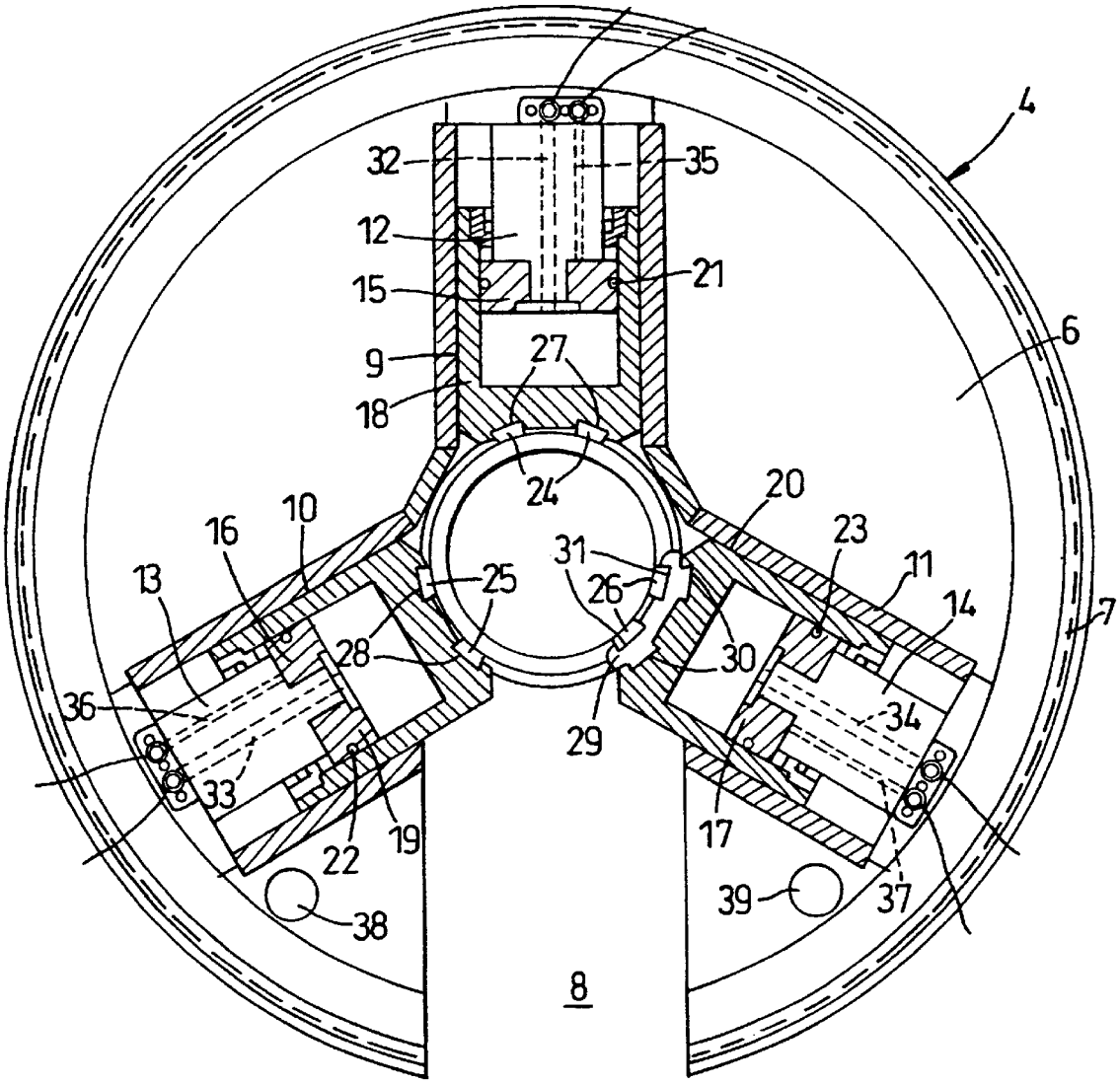
FIG. 2 is a top plan view, partly in cross-section of part of the apparatus of FIG. 1.

Referring to FIG. 2, the rotary 4 comprises a housing 6 which is provided with a toothed ring 7 for engagement with toothed drive wheels in a stator 5 of the drill pipe tong 2. The housing 6 is also provided with an opening 8 for receiving a drill pipe.

Three piston and cylinders 9, 10 and 11 are arranged about the rotary 4 spaced at 120° to each other and are directed to the centre of the rotary 4. The piston and cylinders 9, 10 and 11 comprise static pistons 12, 13 and 14 each provided with a piston head 15, 16 and 17. Cylinders 18, 19 and 20 are slideable along said piston heads 15, 16 and 17 towards and away from the centre of the rotary 4. Sealing rings 21, 22 and 23 are provided in the piston heads 15, 16 and 17 between the piston heads 15, 16 and 17 and the cylinders 18, 19 and 20.

Cylinders 18, 19 and 20 are provided with jaws 24, 25 and 26 for engaging with the upset of a drill pipe. The jaws 24 and 25 are located in corresponding dovetail slots 27 and 28. The cylinder 20 is shown provided with an extension member 29 between the cylinder 20 and the jaws 26. The extension member 29 is located in dovetail slots 30 and the gripping elements 26 are located in corresponding dovetail slots 31 in the extension member 29. In use, either all of the cylinders 18, 19 and 20 are provided with extension members 29 or none of the cylinders 18, 19 and 20 are provided with extension members 29.

Hydraulic lines 32, 33 and 34 and hydraulic lines 35, 36 and 37 are arranged in each piston 12, 13 and 14 for the provision of hydraulic fluid in front of and behind the piston heads 15, 16 and 17.

Two release valves 38 and 39 are arranged on the housing 2. The release valves 38 and 39 are used for retracting cylinders 9, 10 and 11 and hence disengaging the gripping elements 24, 25 and 26 from a section of stand of drill pipe.

Figure 11:
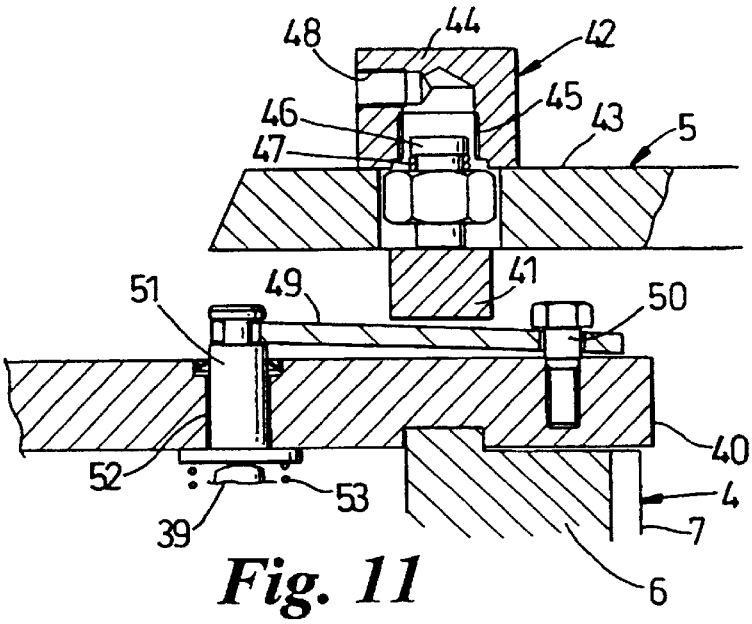
FIG. 11 is a cross sectional view of an arrangement of part of the apparatus of FIG. 1.

Referring to FIG. 11, the rotor 4 has a cover plate 40 through which the release valves 38 and 39 can be accessed. The release valves 38 and 39 may be operated manually or operated by activating mechanisms, two suitable activating mechanisms are shown in FIGS. 11 and 12.

The release valves 38 and 39 are arranged on opposite sides of the rotary so that, when release of the gripping elements 24, 25 and 26 from the drill pipe is required, at least one will be under an activating ring 41, the activating ring 41 being broken across the opening 8. Six activating valves 42 are arranged about the activating ring 41 in lid 43 of the stator 5. Each activating valve 42 comprises a piston housing 44, a cylinder 45, a piston 46, a return spring 47 and a port 48. When it is desired to activate the release valves 38 and/or 39, pneumatic or hydraulic fluid pressure is applied via a control panel (not shown) through port 48 into cylinder 45, displacing piston 46. The piston 46 pushes ring 41 on to plate 49 above release valve 39, and/or plate (not shown) above release valve 38. The plate 49 is retained at one end on a bolt shaft 50 to cover plate 40, and at the other end to a plunger 51 which is slideably arranged in a hole 52 in the cover plate 40. The plunger 51 is biased upwardly by a spring 53 located beneath a plate 54 which extends beyond the diameter of the hole 52. Upon displacement of the ring 41, the plate 49 pushes plunger 51 activating the release valve 39.

Figure 12:
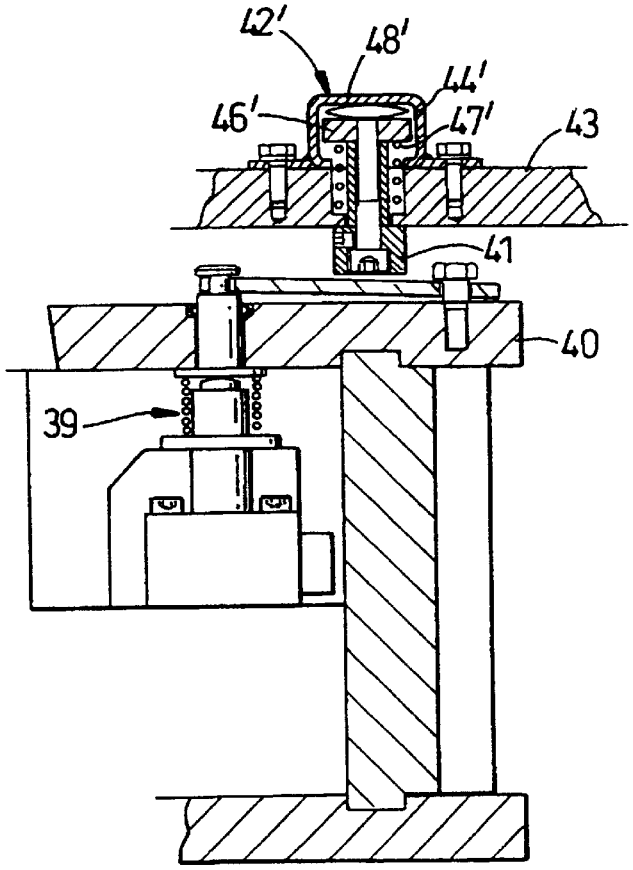
FIG. 12 is a cross sectional view of an alternative arrangement shown in FIG. 12.

An alternative activating mechanism is shown in FIG. 12. The rotor 4 comprises substantially the same arrangement, however the lid 43 comprises activating valves 42' which comprise a piston housing 44', a piston 46', a return spring 47' and a hose 48' arranged between the piston housing 44' and the piston 46'. The hose 48' links the activating valves 42' and leads to a pneumatic or hydraulic fluid supply (not shown). Upon an increase in pressure in the hose 48', the piston 46' is displaced, activating the release valve 39 in the same way as that described above with reference to FIG. 11.

Figure 3A:
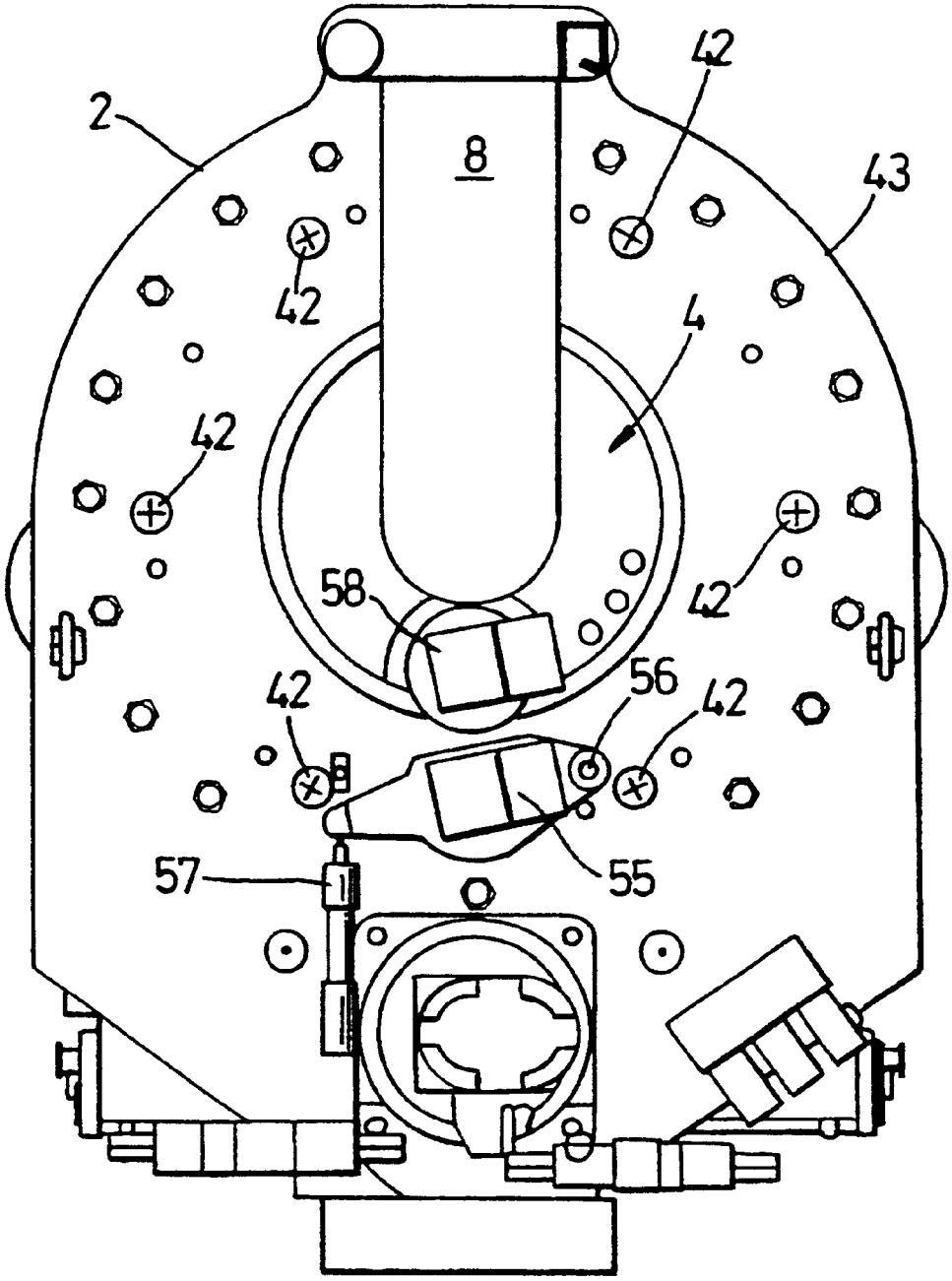
FIG. 3A is a top plan view of the apparatus of FIG. 1 in a first stage of operation.
Figure 3B:
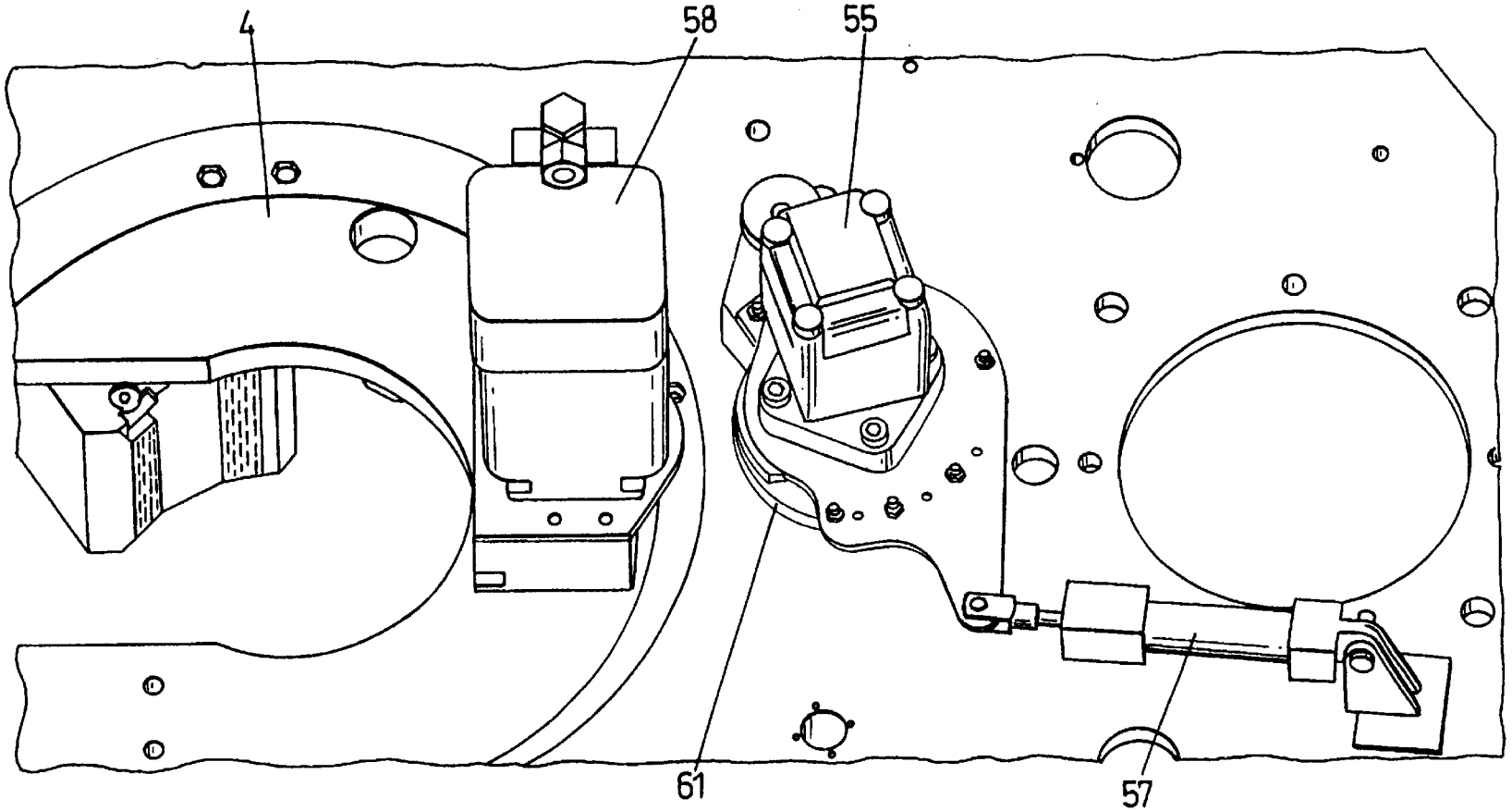
FIG. 3B is a perspective view of part of; the apparatus of FIG. 1 in a first stage of operation.
Figure 4A:
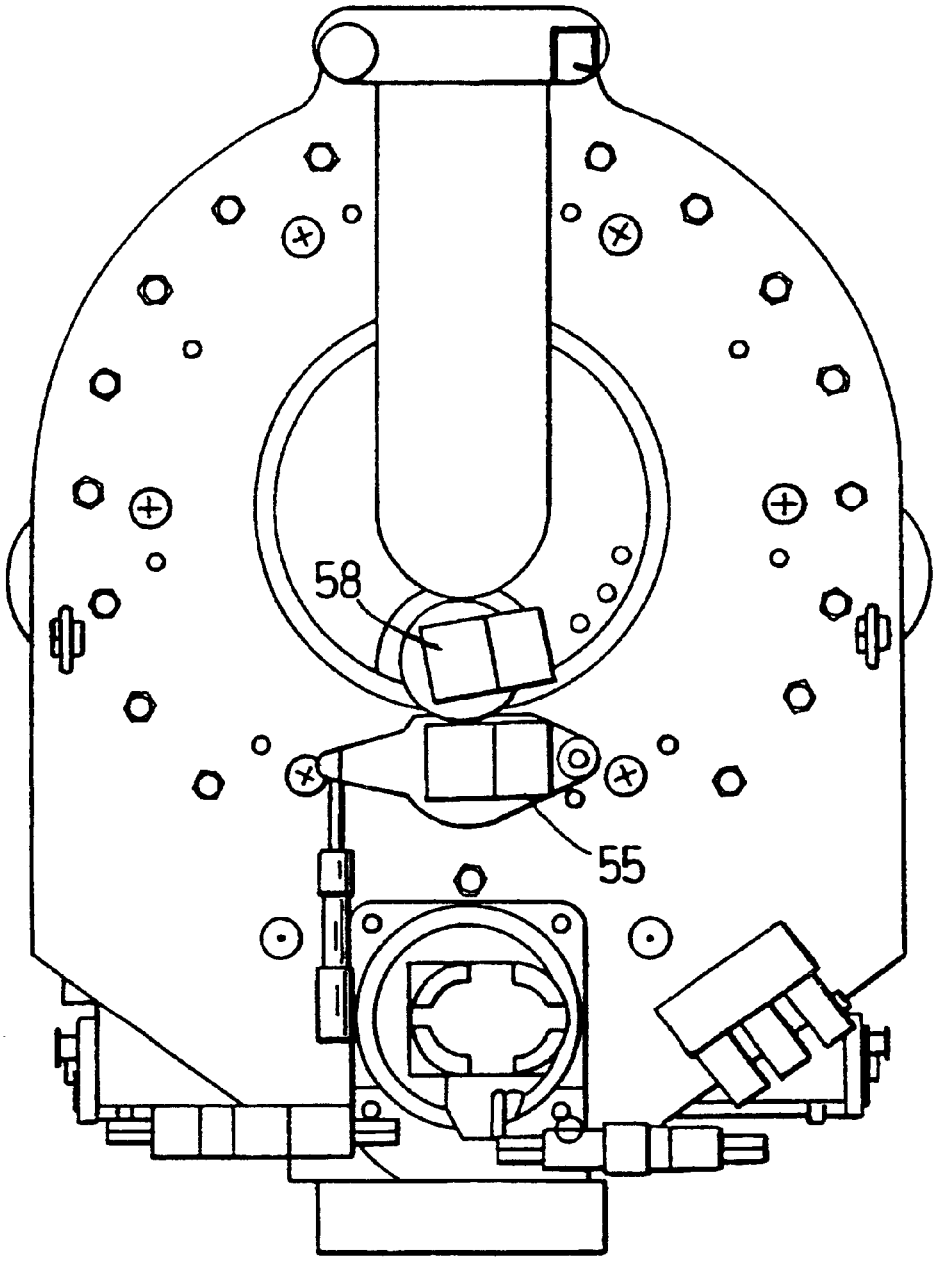
FIG. 4A is a top plan view of the apparatus of FIG. 1 in a second stage of operation.
Figure 4B:
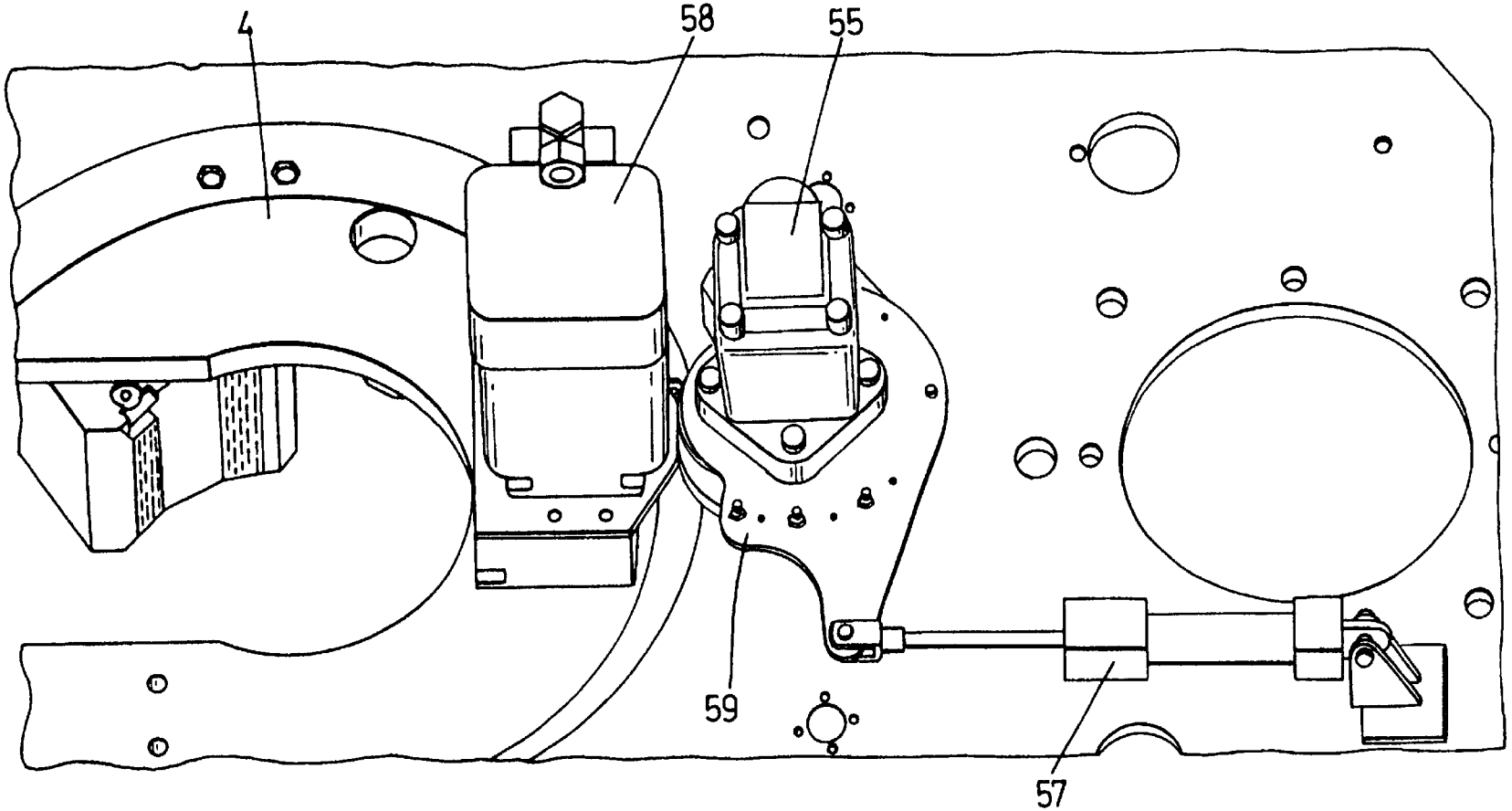
FIG. 4B is a perspective view of part of the apparatus of FIG. 1 in a second stage of operation.

Referring now to FIGS. 3 and 4, there is shown a hydraulic motor 55 arranged on the lid 40 of the stator 5. The hydraulic motor 55 is moveably arranged at one end on a shaft 56 which is fixed to the lid 40 of the stator 5. A piston and cylinder 57 is fixed at one end to the stator 5, and at the other end to one side of the hydraulic motor 55. A hydraulic pump 58 is arranged on the rotor 4.

Figure 5:
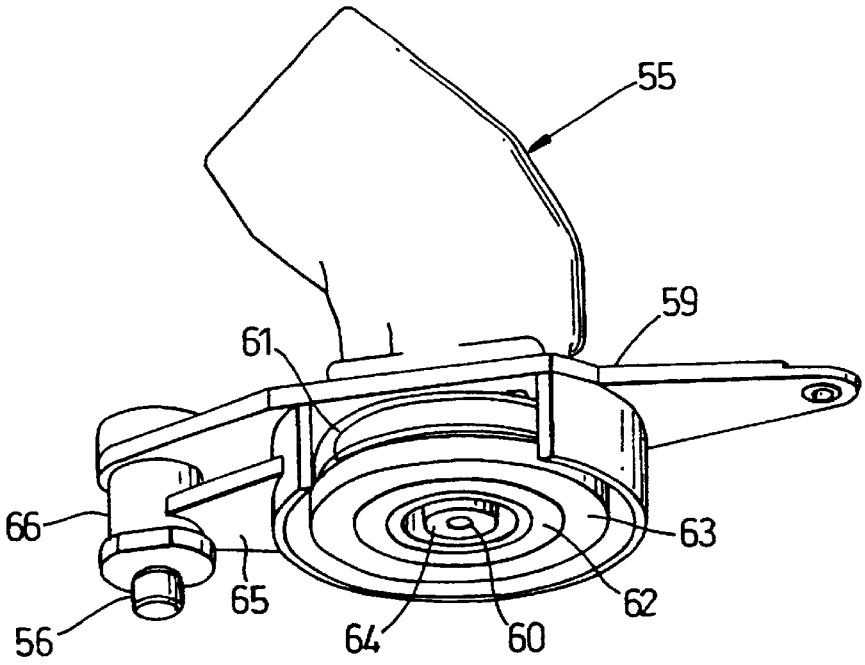
FIG. 5 is a perspective view of a part of the apparatus of FIG. 1.

FIG. 5 shows the hydraulic motor 55 provided with a mounting bracket 59 fixed to the static base thereof. The mounting bracket 59 is provided with a hole through which drive shaft 60 projects. The drive shaft 60 has splines on to which a gear 61 is mounted. A disk 63 is mounted on a bearing 62 which is mounted on the drive shaft 60 below the gear 61. The gear 61 and disk 62 are retained on the drive shaft 60 by a c-clip 64. The mounting bracket 59 has two flanges, one provided with a hole for providing attachment means to the piston and cylinder 57, and the other provided with a lug 65 arranged substantially in parallel therewith which supports a hose 66 through which the shaft 56 is rotatably arranged. The end of the shaft 56 is fixed to the lid 40 of the stator 5.

Figure 6:
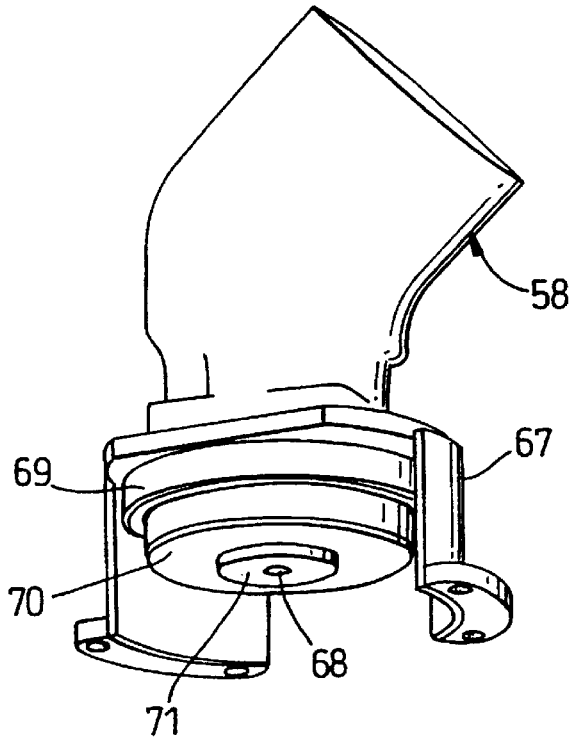
FIG. 6 is a perspective view of another part of the apparatus of FIG. 1.
Figure 7:
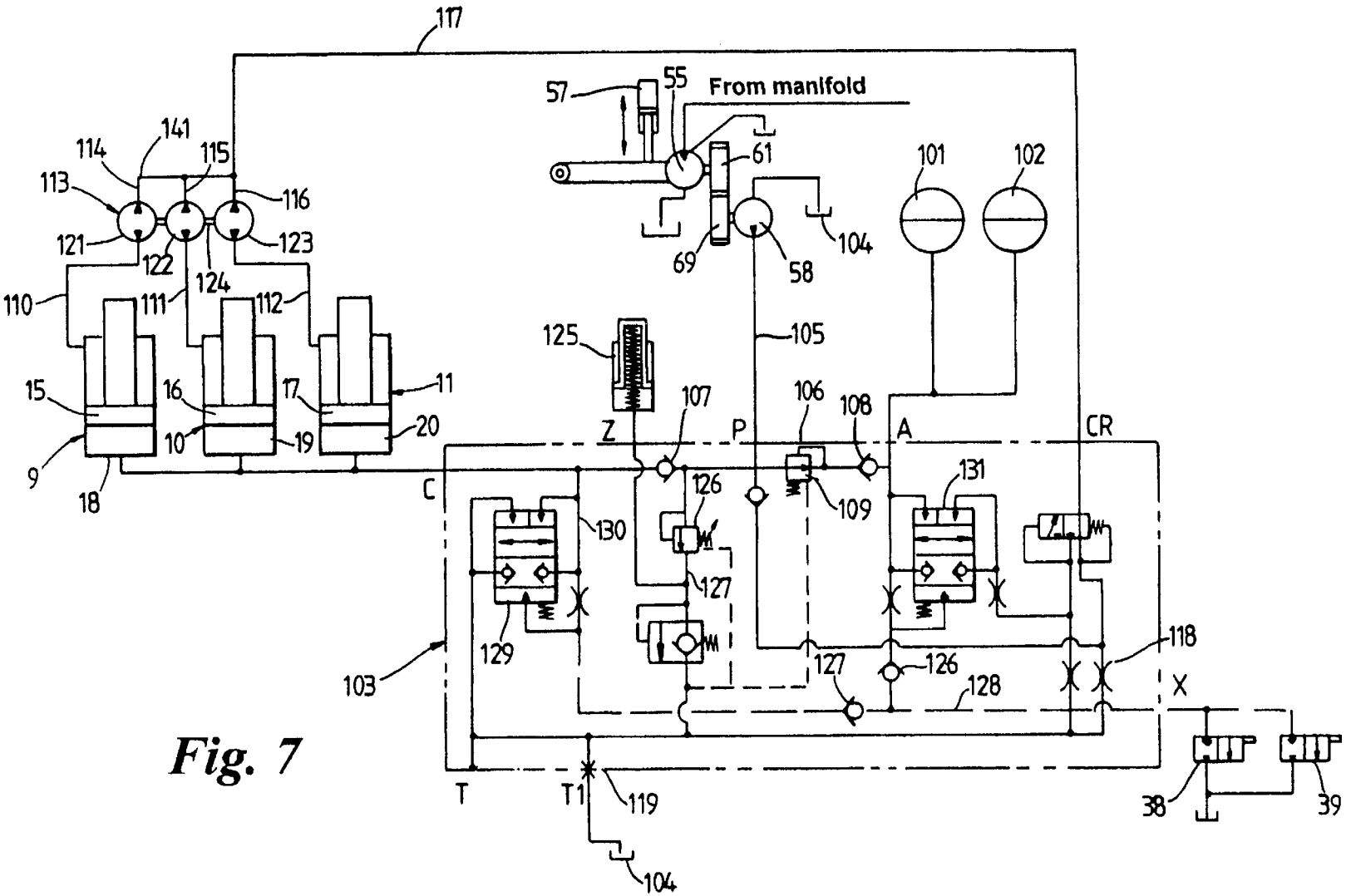
FIG. 7 is a schematic diagram of a part hydraulic, part mechanical circuit used in the apparatus of FIG. 1 in a first stage of operation.

FIG. 6 shows the hydraulic pump 58 provided with a mounting bracket 67 fixed to the static base thereof. The mounting bracket 67 is provided with a hole through which a driveable shaft 68 projects. The driveable shaft 68 has splines on to which a gear 69 is mounted. A disk 70 is integral with and below the gear 69 driveable shaft 68. The gear 69 and disk 70 are retained on the driveable shaft 68 by a cap 71.

Referring back to FIGS. 3A, and 3B the gear 61 of the hydraulic motor 55 is out of engagement with the gear 69 of the hydraulic pump 58. The piston and cylinder 57 is retracted.

Referring back to FIG. 4, the gear 61 of the hydraulic motor 55 is meshing with the gear 69 of the hydraulic pump 58. The piston and cylinder 57 has been operated by pneumatic or hydraulic fluid in to an extended position and has moved the hydraulic motor 55 towards the hydraulic pump 58.

The outer diameter of the disk 63 is of slightly smaller diameter then the gear 61, as is the corresponding disk 70 of the hydraulic pump 58. This controls the depth to which the teeth of the gears 61 and 69 can engage. This improves overall efficiency and reliability. It will be appreciated that disks of any diameter may suffice, as long as they maintain the distance between gears.

Referring now to FIGS. 7 to 10 there is shown a schematic of the part hydraulic, part mechanical circuit of the apparatus of FIG. 1 at various stages of operation. The circuit is generally identified by reference numeral 100.

The circuit 100 comprises a hydraulic pump 58 which is driveable by hydraulic motor 55. The circuit 100 also comprises piston and cylinders 9, 10 and 11 for engaging a tubular, two accumulators 101 and 102 for storing a charge for disengaging the cylinders from engagement with a tubular, a hydraulic circuit 103 and release valves 38 and 39.

In use, initially the hydraulic circuit 103 is not pressurised. The opening 8 of the rotor 4 is in line with the opening 8' of the stator. The hydraulic pump 58 is now situated opposite the opening 8, 8' at the rear of stator 5. The hydraulic motor 55 is in a retracted position (FIG. 3).

Figure 8:
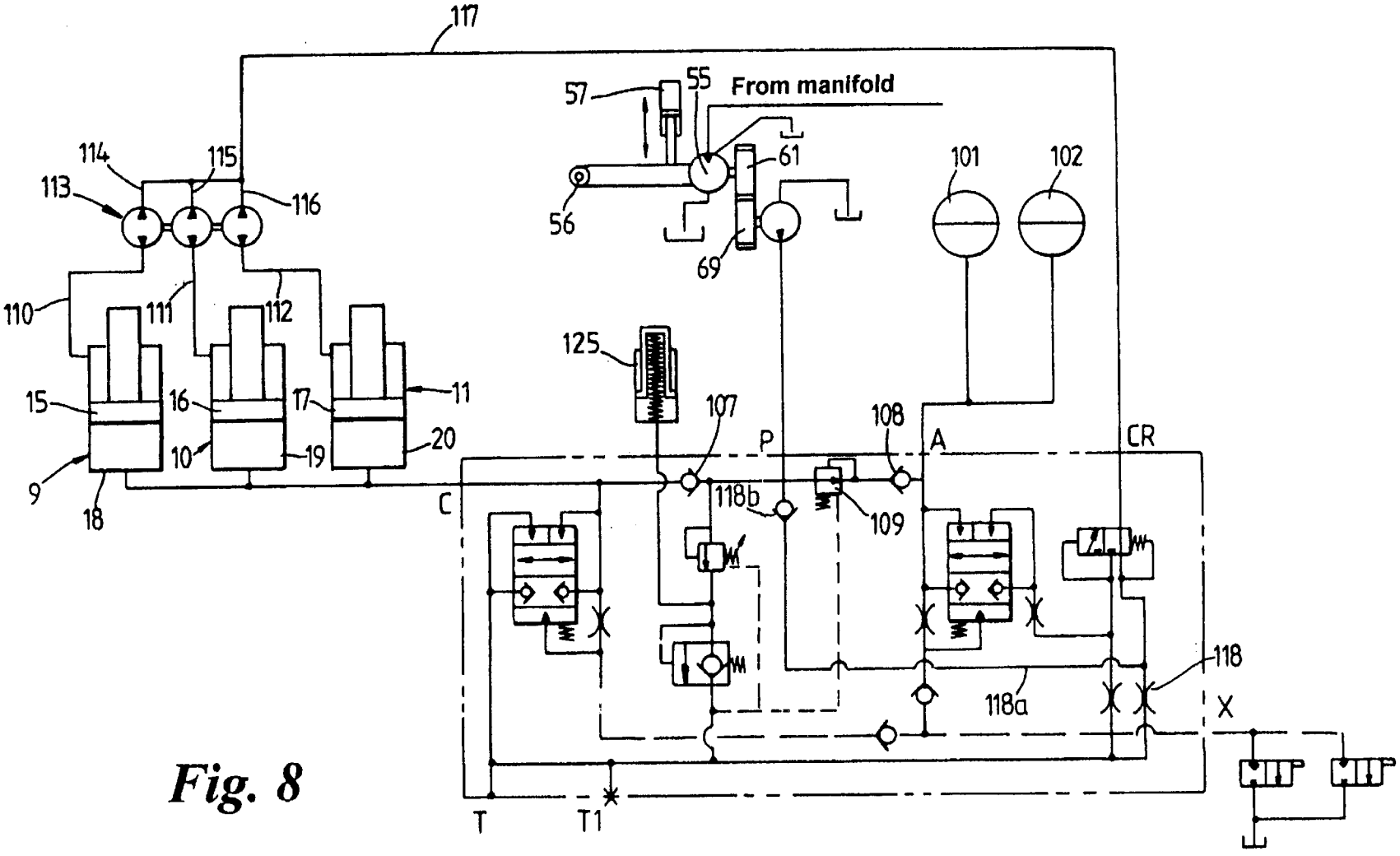
FIG. 8 is a schematic diagram of the part hydraulic, part mechanical circuit of FIG. 7 in a second stage of operation.

When it is desired to use the drill pipe tong, the tong is placed around a box of a stand of tubulars which is to be connected to a string of tubulars, through opening 8, 8'. The piston and cylinder 57 is actuated, extending the piston from the cylinder which moves the hydraulic motor 55 towards the hydraulic pump 58. The gear 61 of the hydraulic motor 55 meshes with the gear 69 of the hydraulic pump 58. The hydraulic motor 55 is driven by an external hydraulic fluid supply (not shown) on the rig floor (FIG. 4). The hydraulic motor 55 drives the hydraulic pump 58 which pumps hydraulic fluid from a tank 104 (shown schematically as a separate tank, although is preferably a single tank) through a line 105 into a continuation of line 105 in a block 106. The hydraulic fluid flows past check valves 107 an 108. Pressure increases in the cylinders 18, 19 and 20 in front of the pistons 15, 16 and 17, which moves the cylinders 18, 19 and 20 into engagement with the box of the tubular to be gripped. Simultaneously, hydraulic fluid flows past check valve 108 into accumulators 101 and 102. Pneumatic pressure in the accumulators builds up to a predetermined level such as 150 Bar, at which point a preset valve 109 closes and prevents further pressure build up in the accumulators 101 and 102 (FIG. 8). At this point, hydraulic fluid only flows into the cylinders 18, 19 and 20. Hydraulic fluid behind the pistons 15, 16 and 17 is expelled through lines 110, 111 and 112, through flow divider 113, through lines 114, 115 into line 116, into common line 117, through line 118*a* valve 118*b* into the cylinders 18, 19 and 20 in front of the pistons 15, 16 and 17. It should be noted that fluid from behind the piston flows to the front of the piston, thereby only requiring a small amount of fluid to be drawn from the tank 104. A flow restrictor 118 inhibits egress of fluid out into tank 104 until the jaws are in firm engagement with the box of the stand of tubulars at which point hydraulic fluid leaks through a flow restrictor 118 and into tank 104 via connection 119, thus inhibiting over engaging the jaws 24, 25 and 26. A hydraulic lock on the front of the pistons 15, 16 and 17 inhibits the jaws 24, 25 and 26 from disengaging during rotation.

The flow divider 113 comprises three rotors 121, 122 and 123 arranged on a common shaft 24. When hydraulic fluid flows across the rotors 121, 122 and 123, the rotors allow equal volumes of fluid to pass, thereby ensuring even movement of the jaws 24, 25 and 26 arranged on the cylinders 18, 19 and 20.

Flow restrictor 118 allows fluid to flow therethrough slowly. This inhibits sudden movement of the cylinders 18, 19 and 20.

Figure 9:
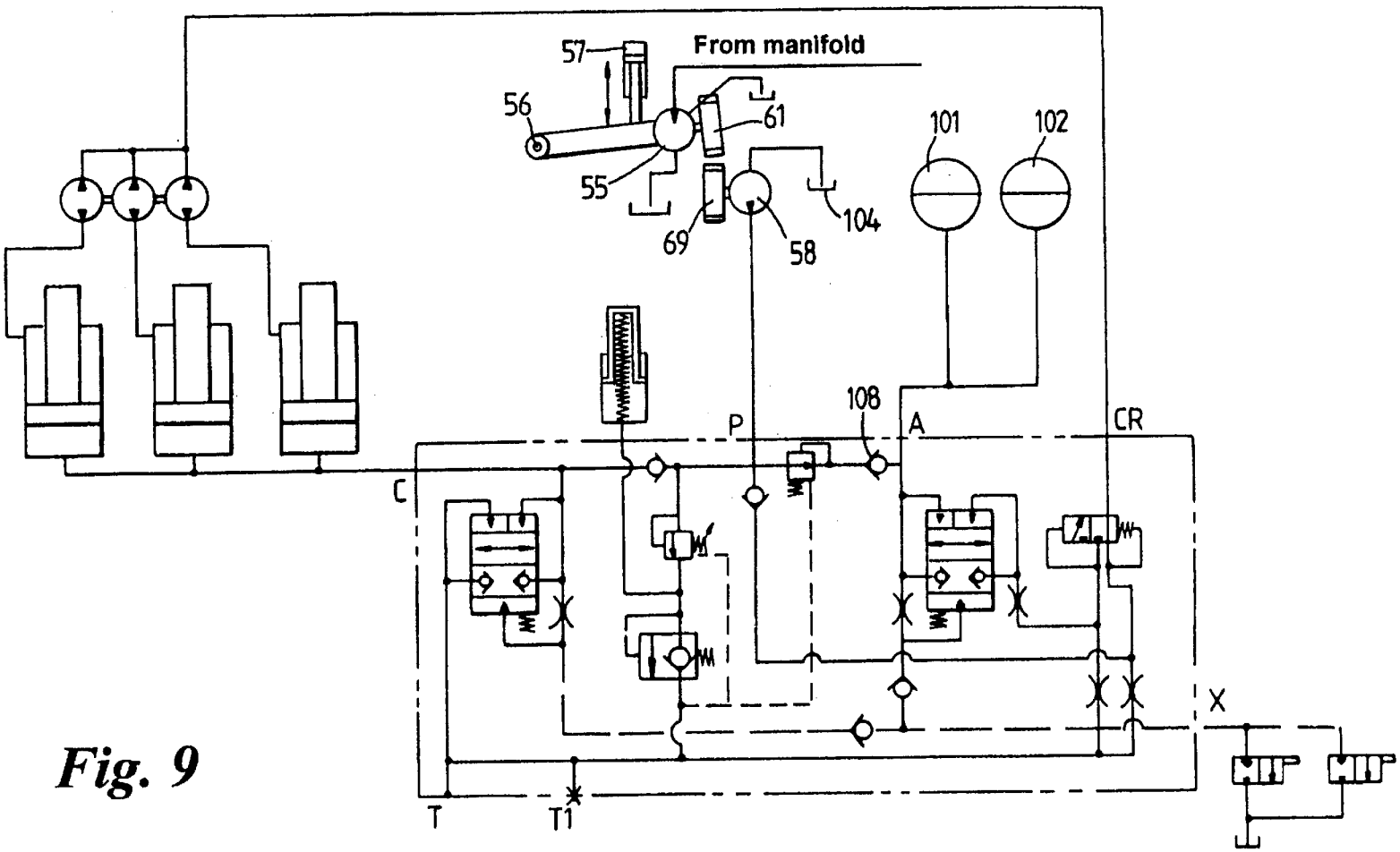
FIG. 9 is a schematic diagram of the part hydraulic, part mechanical circuit of FIG. 7 in a third stage operation.
Figure 10:
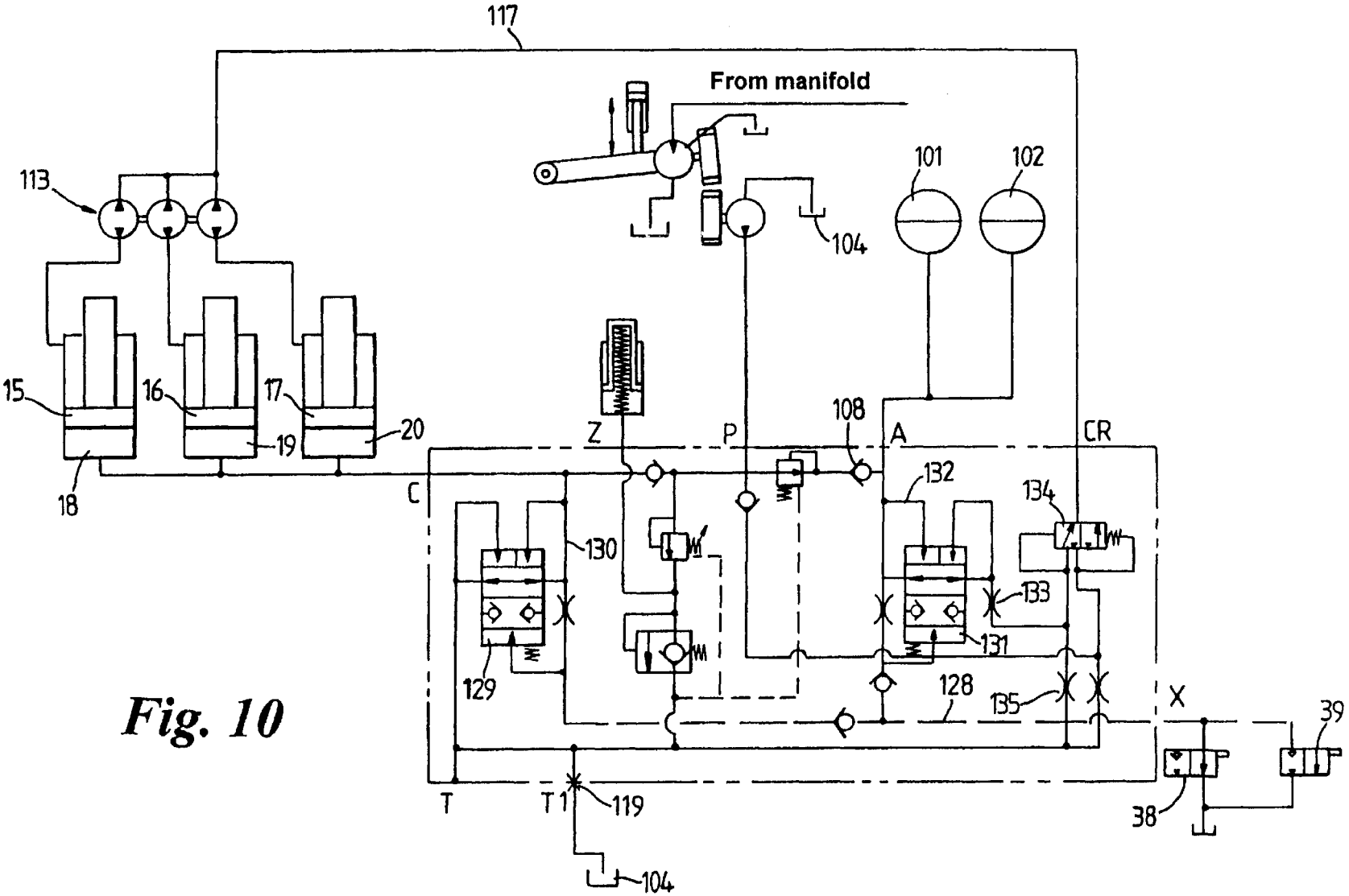
FIG. 10 is a schematic diagram of the part hydraulic, part mechanical circuit of FIG. 7 in a fourth stage of operation.

When a predetermined setting pressure is reached, an indicator 125 moves. This occurs due to valve 126 being set to open at a predetermined pressure, such as 280 Bar. This allows hydraulic fluid to flow through line 127 at a pressure above 280 Bar, say at 287 Bar. If the indicator 125 needs more than 5 Bar pressure to move, the indicator will now move into an extended position, as shown in FIG. 9. Hydraulic fluid at a greater pressure is expelled in to the tank 104.

The hydraulic motor 55 is now swung about shaft 56 by activating piston and cylinder 57 (FIG. 9). Gears 61 and 69 are now out of engagement. The rotor 4 is now rotated relative to the stator 5 to tighten the screw connection between tubulars to a predetermined torque. In this state, the cylinders 18, 19 and 20 are held engaged against the tubular by hydraulic fluid being prevented from escaping by check valve 107, and release valves 38 and 39 being in a closed position.

Fluid is retained in the accumulators 101 and 102 by check valve 108, and a check valve 126 which is maintained in a closed position by hydraulic fluid at greater pressure and by check valve 127 if the pressure is lower on the opposing side of check valve 126.

A particular advantage of the system described is the fact that an external power source can be used to drive the hydraulic motor 55, and this does not need disconnecting before the motor 4 is rotated because it is a simple matter to engage and disengage the motor 55 and the pump 58.

Once the rotor 4 stops rotating, the jaws 24, 25 and 26 may be disengaged form the tubular. This is carried out by pneumatic or hydraulic fluid being pressurised in activating valves 42 which activates release valves 38 and 39, as described above with reference to FIGS. 11 and 12. This releases high pressure hydraulic fluid in control line 128 hence, a reduced pressure occurs on one side of a logic valve 129. The logic valve 129 shifts from a closed to an open position which allows high pressure hydraulic fluid to flow from in front of the pistons 15, 16 and 17 through line 130.

The logic valve 131 also shifts from a closed position to an open position as high pressure hydraulic fluid in line 132 and a reduced pressure occurs in line 128 on the opposing side of the logic valve 131, allowing high pressure fluid from the accumulators 101 and 102 to flow through the logic valve 131, through a restrictor 133. The high pressure hydraulic fluid from the accumulators 101, 102, opens slide valve 134 and passes therethrough, into line 117, through flow divider 113 and into cylinders 18, 19 and 20 behind pistons 15, 16 and 17. The jaws 24, 25 and 26 are hence disengaged from the tubular and retracted therefrom.

It should be noted that hydraulic fluid passes out from in front of the pistons 15, 16 and 17 into the line 130, through logic valve 129, through restrictor 135, through slide switch 134, into line 117, through flow divider 113 into the cylinders 18, 19 and 20 behind the pistons 15, 16 and 17. In this way, only an amount of hydraulic fluid equal to the difference in volumes between the volume in front of the pistons 15, 16 and 17 when in the fully extended position and the volume behind the pistons 15, 16 and 17 when in the fully retracted position is required to be held in the tank 104. This excess fluid flows through connection 119 and into tank 104.

It is also envisaged that the apparatus could be used with thin walled pipe, as it is relatively simple to alter the force applied to the pipe by the jaws. The invention will also be applicable for any tubular or pipe such as casing, tool strings and drill pipes.

It is also envisaged that the accumulator could take the form of a spring or a battery.

It will be appreciated that although the engagement mechanism described comprises gears 61, 69 arranged on the motor 55 and pump 58 respectively any suitable engagement mechanism can be used. For example, a clutch or friction drive could be employed to engage and disengage the motor from the pump. However, a particular advantage of gears 61, 69 rotating in the same place as the rotor 4 is that if the motor 55 is not disengaged from the pump 58 before the rotor 4 is rotated, the components avoid serious damage.

What is claimed is:

1. An apparatus for facilitating the connection of pipes and comprising a rotary and a stator, the rotary comprising at least one hydraulically actuated jaw, and a pump arranged on the rotary for pumping hydraulic fluid for actuation of the at least one jaw, the stator comprising a motor arranged on the stator, so that rotational energy can be transferred from the motor to the pump in an operational configuration, characterized in that the motor comprises driving means and the pump comprises pump driving means, the driving means and pump driving means being mechanically engageable.

2. The apparatus of claim 1, wherein the driving means and the pump driving means are rotatable in the same plane as the rotary.

3. The apparatus of claim 2, wherein the motor is rotatably arranged on the stator via a shaft so that the motor can be moved in and out of engagement with the pump by rotating the motor around the shaft.

4. The apparatus of claim 3, wherein a piston and cylinder is fixed at one end to the stator, and at the other end to the motor for moving the motor to bring the driving means and the pump driving means in and out of engagement.

5. The apparatus of claim 1 wherein the motor comprises a first gear and the pump comprises a second gear, the first gear and second gear being engageable to transfer said rotational energy.

6. The apparatus of claim 5, wherein the first gear is mounted on a drive shaft and the second gear is mounted on a driveable shaft, and wherein a first disc is mounted on the drive shaft and a second disc is mounted on the driveable shaft so that, when the first gear and second gear engage, the first disc contacts the second disc so as to control the depth to which the teeth of the first gear and the second gear mesh with each other.

7. The apparatus of claim 1, wherein the rotary comprises at least one piston arranged in a cylinder for actuating said at least one jaw, and a hydraulic circuit linking a first chamber in front of said piston and a second chamber to a rear side of said piston such that, in use, hydraulic fluid is expelled from one of said first or second chambers and replenishes the other of said first and second chambers.

8. The apparatus of claim 7, comprising at least two pistons, each arranged in a respective cylinder.

9. The apparatus of claim 8, further comprising a flow divider.

10. The apparatus of claim 7, further comprising a tank for holding hydraulic fluid.

11. The apparatus of claim 7, further comprising at least one accumulator holding a charge for release of the at least one jaw from engagement with a pipe.

12. The apparatus of claim 1, wherein the rotary comprises at least one piston arranged in a cylinder for actuating said at least one jaw and a hydraulic circuit, wherein said hydraulic circuit comprises a valve preventing return flow of hydraulic fluid and a restriction such that, in use, the arrangement allows a finite force to be applied to said pipe.

13. A method for facilitating the connection of pipes, comprising mechanically engaging a motor attached to a stator with a pump attached to a rotor and transferring rotational energy from the motor to the pump, enabling the pump to drive hydraulic fluid to actuate at least one jaw.

14. The method of claim 13, comprising the step of moving the motor from a first position in which it is disengaged from the pump to a second position in which the motor and the pump are engaged to transfer rotational energy from the motor to the pump.

15. The method of claim 13, further comprising expelling hydraulic fluid from one of the front or rear sides of at least one piston arranged in a cylinder to actuate the at least one jaw for gripping the pipe, and replenishing the other of said front or rear sides of said piston.

16. The method of claim 13, further comprising driving hydraulic fluid around a hydraulic circuit to actuate at least one piston arranged in a cylinder to actuate the at least one jaw for gripping the pipe, and allowing hydraulic fluid to leak from said hydraulic circuit such that said at least one jaw applies a finite force to said pipe.

17. A method for facilitating the connection of pipes, the method using the apparatus as claimed in claim 12, the method comprising the step of allowing hydraulic fluid to leak from said hydraulic circuit such that said at least one jaw applies a finite force to said pipe.

18. A method for facilitating the connection of pipes, the method using the apparatus of claim 7, the method comprising the step of expelling hydraulic fluid from one of said front or rear sides of said piston and replenishing the other of said front or rear sides of said piston.

19. An apparatus for facilitating the connection of pipes, comprising:

a rotary comprising at least one hydraulically actuated jaw;

a stator;

a motor arranged on the stator and comprising a driving member, wherein the motor is actutatable between a first position and a second position; and a pump arranged on the rotary for pumping hydraulic fluid for actuation of the at least one jaw and comprising a driving member, wherein the motor driving member and the pump driving member are engageable, when the motor is in the second position, for transferring energy from the motor to the pump.

* * * * *